United States Patent [19]

Weber

[11] Patent Number: 4,835,349

[45] Date of Patent: May 30, 1989

[54] AUTOMATIC SHUT-OFF APPLIANCE TIMER

[75] Inventor: Glenn T. Weber, Troutman, N.C.

[73] Assignee: Taltronics Corporation, Phoenix, Ariz.

[21] Appl. No.: 168,761

[22] Filed: Mar. 16, 1988

[51] Int. Cl.[4] ..... H01H 7/00; H01H 43/00

[52] U.S. Cl. ..... 200/38 R; 200/38 A; 200/38 FA; 200/38 FB; 200/38 F

[58] Field of Search ..... 200/35 R, 38 R, 38 A, 200/38 F, 38 FA, 38 FB, 38 D; 368/262, 263

[56] References Cited

U.S. PATENT DOCUMENTS

| | | | |
|---|---|---|---|
| 2,977,433 | 3/1961 | Beiser et al. | 200/38 FB |
| 3,033,948 | 5/1962 | Boyles | 200/38 FB |
| 3,052,766 | 9/1962 | Koehler | 200/38 FB |
| 3,078,358 | 2/1963 | Enochs et al. | 200/38 FB |
| 3,100,961 | 8/1963 | Bassett | 368/254 |
| 3,109,280 | 11/1963 | Ring et al. | 368/263 |
| 3,192,776 | 7/1965 | Ring et al. | 74/3.5 |
| 3,387,452 | 6/1968 | Ring et al. | 368/263 |
| 3,400,233 | 9/1968 | Ring | 200/38 FB |
| 3,445,612 | 5/1969 | Wolber et al. | 200/38 FB |
| 3,475,899 | 11/1969 | Boyles | 368/263 |
| 3,498,048 | 3/1970 | Jepson et al. | 368/262 |
| 3,618,310 | 11/1971 | Balchunas | 368/263 |
| 3,686,878 | 8/1972 | Patrick et al. | 368/263 |
| 3,924,399 | 12/1975 | Robinson | 368/72 |
| 3,930,360 | 1/1976 | Boyles | 368/263 |
| 4,041,325 | 8/1977 | Angott | 307/141 |
| 4,695,683 | 9/1987 | Wingler et al. | 200/38 R |

*Primary Examiner*—J. R. Scott

*Attorney, Agent, or Firm*—Pennie & Edmonds

[57] ABSTRACT

An improved automatic shut-off appliance timer is disclosed which actuates an associated appliance at a set-time and deactuates it a fixed period of time later. The timer comprises a clockwork mechanism, including a cam wheel and a trip wheel which approach one another when the set-time is reached. The relative position of the two wheels is set to define the set-time. When the set-time is reached, a cam follower resting on one of the cam wheel and trip wheel is permitted to move axially, moving a switch shaft and allowing electrical contacts to abut, closing the circuit of the associated appliance. Thereafter, a sector gear also comprised by the switch shaft is engaged by the motor, positively rotating the switch shaft. A cam follower integrally carried by the switch shaft then moves along a drop-off cam formed integrally with the front plate of the timer. When the predetermined period of time has passed, the drop-off cam allows the switch shaft to move further axially, which separates the contacts and deactuates the appliance.

17 Claims, 3 Drawing Sheets

114
128
130
112a
116
132
112
126a
126d
126b
122
118
118a
126c
124
126
120
120a
110a
110

AUTOMATIC SHUT-OFF APPLIANCE TIMER

FIELD OF THE INVENTION

This application relates to an improved automatic shut-off appliance timer. More particularly, this invention relates to a timer which can be used to turn an appliance on at a first specified time and turn it off after a predetermined interval of time.

BACKGROUND OF THE INVENTION

It has been commonplace for many years to provide electric appliances, such as coffeemakers and to the like, with timers which activate the appliance at a specified hour. For example, coffeemakers are provided with clockwork timers which turn the coffeemaker on at a specified hour, the "set-time" hereinafter, such that when the user of the appliance awakes, the coffee is ready. As indicated, such timers are known which are clockwork drive, that is, driven by a continually rotating electric motor through a gear train; digital timers are also known for this purpose. The present invention relates to clockwork driven appliance timers.

More recently there have been developed clockwork timers having the additional capability of shutting the appliance off a specified period after the set-time. Such a timer is shown in Wingler et al. U.S. Pat. No. 4,695,683. In this way, for example, the danger of fire which might be caused by the user of the appliance forgetting to turn the power off is substantially eliminated. However, the Wingler et al. timer is unduly complex to manufacture.

Other types of clockwork timers generally pertinent to the subject matter of this invention include those employed in clock radios. As is well known, clock radios can typically be operated in a "drowse" mode whereby the user turns the radio on when he retires. In this mode, the clock radio plays for a predetermined period of time and shuts itself off. Clock radios of this general type employing clockwork timers are shown in U.S. Pat. No. 3,387,452 to Ring et al. and others.

Clock radios operated in the drowse mode as thus defined can be distinguished from automatic shut-off appliance timers as described above in that such clock radios are not automatically activated at a specified time. Instead they are activated by the user.

SUMMARY OF THE INVENTION

The present invention provides an automatic shut-off appliance timer which is substantially simplified and thus rendered less expensive with respect to timers of comparable function, such as shown in Wingler et al. The present invention comprises a clockwork timer in which an axially movable and rotatable switch shaft controls electrical contacts which activate an associated appliance such as a coffeemaker. When the user desires to set the appliance to turn itself on at a specified set-time, he rotates the switch shaft. A cam follower on the switch shaft rides up onto a cam wheel, moving the switch shaft axially. The cam wheel is spaced from a trip wheel, such that when the set-time is reached, they approach one another. When the set-time is reached the switch shaft also moves axially, allowing the electrical contacts controlling the associated appliance to be closed. At this time, a sector gear formed integrally with the switch shaft engages an hour wheel which is driven by the clock motor. Thus, beginning at the set-time, the switch shaft is rotated by the hour wheel. As the sector gear is rotated, another cam follower on the switch shaft rides along a stationary cam. When the end of the period during which the associated appliance is to be activated is reached, this latter cam follower drops off the stationary cam, whereupon the switch shaft again moves axially, opening the contacts and deactivating the associated appliance.

BRIEF DESCRIPTION OF THE DRAWINGS

The invention will be better understood if reference is made to the accompanying drawings, in which.

DESCRIPTION OF THE PREFERRED EMBODIMENTS

Figure 1:
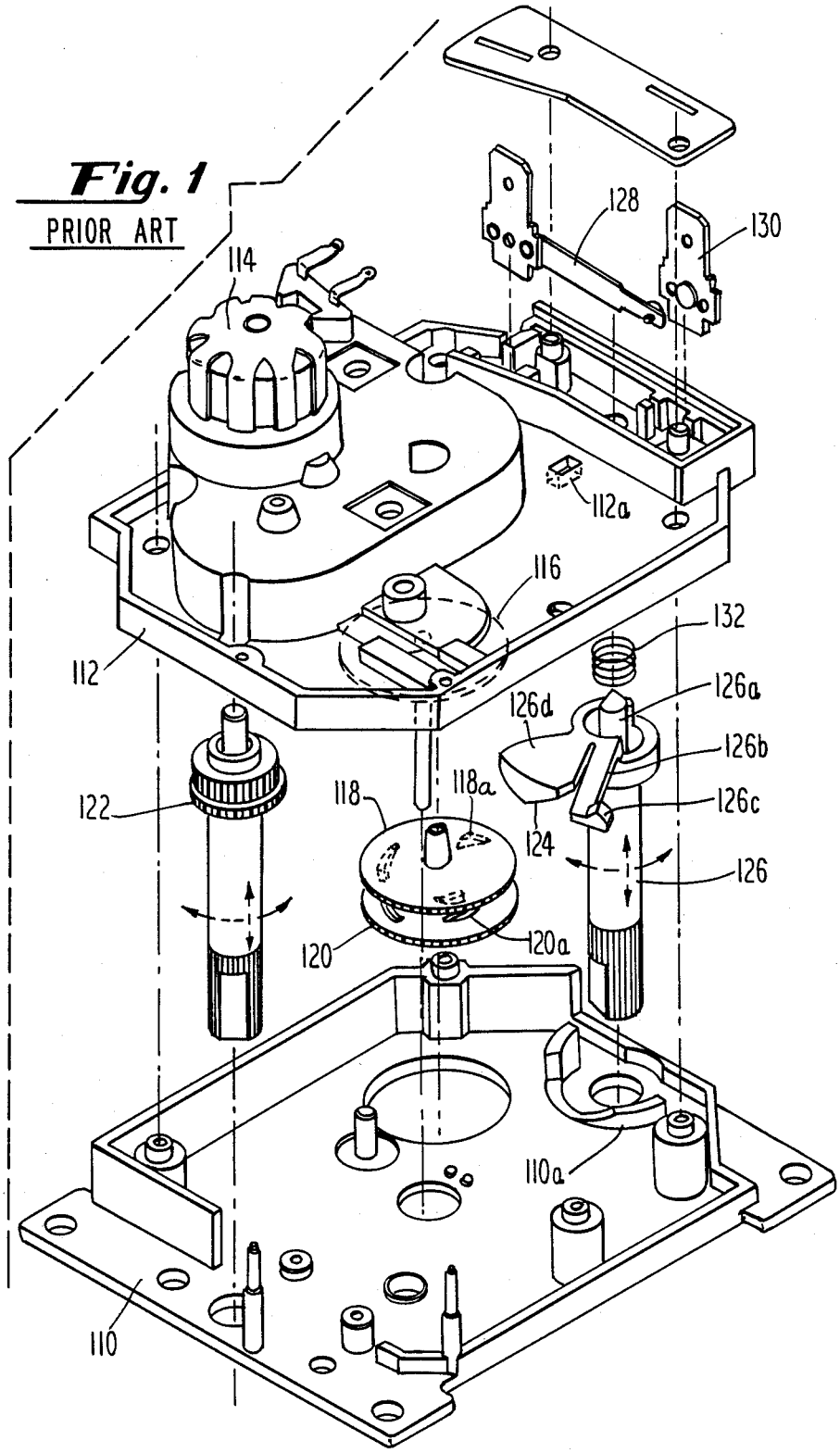
Fig. 1 PRIOR ART
FIG. 1 shows a exploded perspective view of a prior art appliance timer lacking the automatic shut-off feature according to the invention.

As mentioned, FIG. 1 shows an appliance timer which is in the prior art and which, in fact, has been sold by the assignee of the present application for some years. This timer comprises a front plate 110 and a mating back plate 112 which carry a number of shafts. A motor 114 drives a clockwork mechanism including an hour wheel 116 which in turn drives a cam wheel 118. Mounted co-axially with the cam wheel 118 is a trip wheel 120. The cam wheel 118 is set in order to determine the set-time by rotation of a set shaft 122 which protrudes through the front plate 110.

The cam wheel 118 has formed integrally thereon a number of arcuate projections **118*a* which are shaped to fit within mating actuate recesses 120*a* formed on the trip wheel 120 when the two wheels are appropriately aligned. Accordingly, in setting the set-time, the user rotates the set shaft 122, rotating the cam wheel 118. The projections 118*a* are shaped such that when the user does so, the projections 118*a* force the cam wheel 118 to be spaced from the trip wheel 120 by the projections 118. Subsequently, as the motor 114 turns the hour wheel 116 and the trip wheel 120, the projections 118*a* are ultimately aligned with the actuate slots 120*a*. This allows the cam wheel 118 to approach the trip wheel 120** at the set-time.

A cam follower 124 is formed on an arm **126*d* formed integrally with a switch shaft 126. When the switch shaft 126 is rotated by the user to set the timer, the cam follower 124 rests on the cam wheel 118. At the set-time, when the cam wheel 118 approaches the trip wheel 120, the switch shaft 126 moves axially downwardly in the view of FIG. 1**.

The switch shaft 126 comprises an elongated projection **126*a* which extends between a movable contact 128 and a stationary contact 130. Contacts 128 and 130 control the associated appliance. When the switch shaft moves axially, projection 126*a* is moved axially with respect to contact 128, allowing it to move with respect to the stationary contact 130. Thus, axial movement of the switch shaft 126 controls the sequence of activation of the associated appliance operatively connected to the stationary and movable contacts 128 and 130**.

When the switch shaft 126 moves axially at the set-time, cam follower 124 drops off cam wheel 118. The subsequent movement of the switch shaft 126 is controlled by the position of cam follower 124 with respect to cam surfaces 110*a*, which are formed integrally with the front plate 110. A spring 132 biases the switch shaft 126 and hence the cam follower 124 axially against the cam surfaces 110*a*. The switch shaft 126 moves axially and rotates as cam follower 124 moves down an inclined surface formed as part of the cam surface 110*a* when it is released by motion of the cam wheel 118 towards the trip wheel 120 at the set-time. This motion of the switch shaft 126 allows the contacts to abut, activating the associated appliance at the set-time.

As indicated on FIG. 1, switch shaft 126 may comprise an "off arm" 126*b*. Arm 126*b* comprises a projecting member 126*c* for interaction with a recess 112*a* formed in the back plate; this interaction holds the switch shaft 126 radially in its "set" position. The spacing of the cam wheel from the trip wheel holds the switch shaft axially against the bias of spring 132, that is, after the device has been actuated by the user but before the set-time has been reached.

Figure 2:
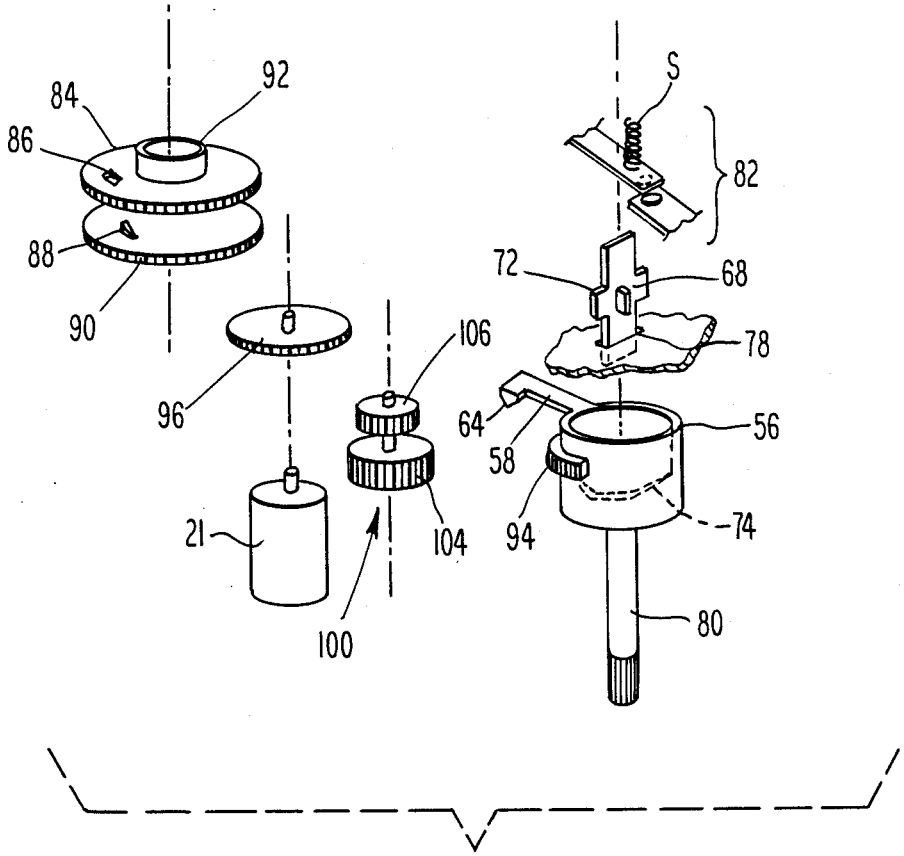
Fig. 2 PRIOR ART
FIG. 2 shows an exploded perspective view of the automatic shut-off timer described in the Wingler et al. patent.

FIG. 2 shows an exploded three dimensional perspective view of the appliance timer with automatic shut-off shown in U.S. Pat. No. 4,695,683 to Wingler et al.

The Wingler et al. automatic shut-off appliance timer is driven by a motor 21, which drives an hour wheel 96 at one revolution per twelve-hour period. Hour wheel 96 drives a timing gear 84. The relative positions of timing gear 84 and a setting gear 90 define the set-time. Normally a tooth 88 on the setting gear 90 (shown as a straight pin in the Wingler et al. patent) spaces the setting gear 90 from the timing gear 84. In this position a cup detent 92 formed on the timing gear 84 retains a projection 64 on a latching arm 58. Latching arm 58 is formed integrally with a cup 56 carried by a selector shaft 80, which is biased to rotate counterclockwise (referring to FIG. 2).

When the set-time is reached, tooth 88 lines up with and slides into a slot 86 in the timing gear 40, so that timing gear 84 approaches the setting gear 90. This releases projection 64, allowing cup 56 to rotate counterclockwise. A cam 74 formed on the internal wall surface of the cup 56 then also rotates, allowing a cruciform actuator 68 comprising cam followers 72 to drop more deeply into the cup 56. Actuator 68 slides in a slot 78, so as to be restrained against rotation. Actuator 68 is biased downwardly by a spring S carried internally by a micro switch 82. When the actuator 68 moves downwardly, the contacts of the switch 82 close, energizing an associated appliance.

At the set-time, when the timing gear 84 approaches the settng gear, the cup detent 92 releases the latching arm 58, allowing the cup 56 to rotate, as described. A sector gear 94 also formed integrally with the cup 56 is likewise rotated into engagement with a first gear 106 of a friction gear assembly 100. Gear 106 is driven via frictional engagement with a driven gear 104, which is driven by the hour wheel 96 via timing gear 84. Accordingly, the friction assembly 100 begins to positively rotate the cup 56 at the set-time. As the cup 56 rotates, the cam followers 72 of actuator 68 move along and are gradually raised by the cam 74. Eventually the actuator 68 is raised high enough to re-open the contacts of switch 82, de-energizing the associated appliance, that is, at the end of the delay period.

As can be seen, the Wingler et al patent describes a relatively complex mechanism involving the cruciform actuator 68 which moves axially, the rotating cup 92 having an internal cam 74 and projection 64 formed thereon. Projection 64 must be retained by the cup detent 56. Further, the friction assembly 100 is required in the Wingler et al. design to permit setting of the set-time; this assembly is somewhat critical of fabrication. Accordingly, a simpler mechanism is required.

Figure 3:
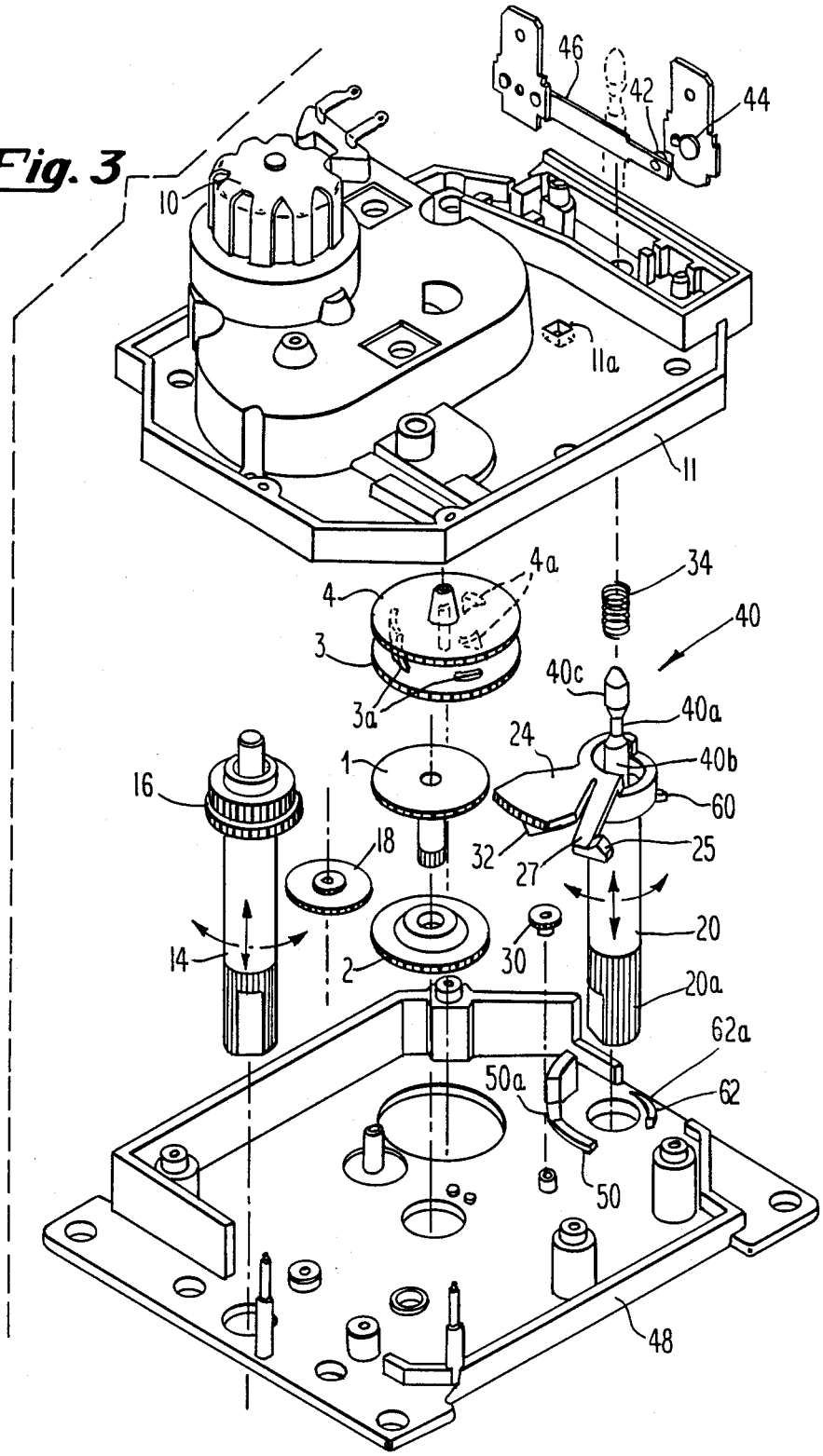
FIG. 3 shows an exploded perspective view of the automatic shut-off clockwork appliance timer according to the invention.

A simpler mechanism providing an automatic shut-off feature according to the invention is shown in FIG. 3. A motor 10 drives the unit via an intermediate gear 18, which drives an hour wheel 1 and a cam wheel 4 which rotate every 12 hours. Mounted coaxially with the cam wheel 4 is a trip wheel 3. The cam wheel 4 comprises a number of arcuate projections 4*a* which are juxtaposed to the trip wheel 3. A corresponding number of arcuate slots 3*a* are formed in the trip wheel 3. When the alarm is set, that is, prior to reaching of the set-time, the projections 4*a* space the cam wheel 4 from the trip wheel 3. When the set-time is reached, the projections 4*a* line up with the slots 3*a*, and the cam wheel 4 is permitted to approach the trip wheel 3.

Accordingly, the relative radial position of the projections 4*a* with respect to the slots 3*a* defines the set-time. This relative position is controlled by the user by rotation of a set shaft 14, a gear 16 on which meshes with the trip wheel 3, through an intermediate alarm set wheel 2. As mentioned, the cam wheel 4 is driven by the motor 10 via an idler gear 18. Of course, the inverse arrangement is also possible.

One end 20*a* of a switch shaft 20 protrudes through the front face of the timer and becomes a control member. The other end of the switch shaft 20 has a sector gear 24 formed integrally thereon, which is arranged to mesh with a further idler gear 30 driven by the hour wheel 1. A cam follower 32 is formed underneath the sector gear 24, and rides atop the cam wheel 4 (that is, on its surface which does not include the projections 4*a*) when the sector gear 24 is aligned with the cam wheel. The switch shaft 20 is biased downwardly (in the view of FIG. 3) by a spring 34. Therefore, when the set-time is reached, the switch shaft 20 moves downwardly together with the cam wheel 4.

Prior to the set-time, a projection 25 formed on an arm 27 is engaged within a stop recess 11*a* formed in the backplate 11, preventing rotation of the switch shaft 20 until the cam wheel 4 approaches the trip wheel 3, allowing the switch shaft 20 to move axially.

A contact-controlling cam 40 extends axially from the switch shaft 20 and controls the motion of a leaf spring 46 carrying a movable electrical contact 42 juxtaposed to a fixed contact 44. When closed, these contacts activate the associated appliance. The cam 40 comprises a relatively thin central section 40*a*, and thicker end sections 40*b*, 40*c*. The appliance is thus controlled depending on the axial position of the cam 40 with respect to the leaf spring 46 carrying one of the contacts. As presently used, the appliance is turned on when the contacts abut, i.e., when the thin central section 40*a* of cam 40 is juxtaposed to leaf spring 46.

When the timer is "set", that is, before the set-time is reached, the leaf spring 46 is juxtaposed to the thick section 40*b* of the cam 40, so the appliance is off. At the set-time, when the cam wheel 4 approaches the trip wheel 3, the switch shaft 20 is permitted to move downwardly (as shown in FIG. 3) under the bias provided by spring 34. Thereafter, the axial positions of the switch shaft 20 and hence of the cam 40 are controlled by further cams 50 and 62, which are formed integrally with the front plate 48.

When the switch shaft drops at the set-time, the thin central section 40*a* of cam 40 is juxtaposed to leaf spring 46. This allows the contacts 42, 44 to abut, turning on the associated appliance.

After cam follower 32 drops off the cam wheel 4, it rests initially on cam 50 formed in front plate 48. The cam 50 comprises a first inclined portion 50*a* against which the cam follower 32 is urged by spring 34 when the cam wheel 4 drops toward the trip wheel 3. This causes the switch shaft 20 to rotate (counterclockwise, referring to FIG. 3), so that the sector gear 24 clears the cam and trip wheels 4 and 3. The sector gear 24 is rotated by movement of cam follower 32 along cam 50 into engagement with idler gear 30, which as noted above is meshed with hour wheel 1. Sector gear 24 and therefore switch shaft 20 are then positively rotated counterclockwise. As this occurs, cam follower 32 moves along a flat portion of cam 50. At the same time, a second cam follower 60 also formed integrally with switch shaft 20 moves along second drop-off cam 62, also formed in front plate 48. When cam follower 60 reaches a downwardly-inclined portion 62*a* of cam 62, it begins to lower switch shaft 20. Ultimately, cam follower 60 drops completely off cam 62, which allows portion 40*c* of cam 40 to displace leaf spring 46 out of the contacts-closed position, such that contacts 42, 44 part, deactivating the associated appliance. At the same time sector gear 24 drops out of engagement with idler gear 30, ending rotation of switch shaft 20.

The manual mode of operation, in which the user simply activates the associated appliance, is similar. In this case, the user rotates the switch shaft 20 until the cam followers 32, 60 are on the flat portions of the associated cams 50, 62, respectively. This energizes the associated appliance, and causes the sector gear 24 to engage idler gear 30, beginning the "deactuation" sequence as described above. In so doing the user places the mechanism in the status it would have reached at the set-time. The user does so simply by rotating the switch shaft less than he would have in order to "set" the timer, that is, to set it to activate the associated appliance.

It will be appreciated that the device of the invention as described initiates the delay period automatically at the set-time, and ends it similarly. That is, when the set-time is reached, the cam wheel 4 approaches the trip wheel 3. This allows the contacts to close, activating the associated appliance. At the same time, sector gear 24 engages idler gear 30; this initiates the deactuation operation which culminates at the end of the delay period, when the appliance is turned off.

It will be appreciated from comparison of the mechanisms shown in FIGS. 2 and 3 that according to the invention a substantial simplification in automatic shut-off appliance timers is realized. Specifically, the friction assembly of the Wingler et al. patent of FIG. 2 is completely eliminated, whereas the rotating cam with external sector gear and projection 64, together with the cruciform actuator 68, are all eliminated in favor of the much simpler switch shaft 20 according to the invention in combination with the drop-off cams 50 and 62 formed integrally with the front plate 48. As can be seen from comparison of FIG. 1 with FIG. 3, minimal new tooling is required to produce the automatic shut-off timer of FIG. 3.

It will be appreciated that a more complex operating sequence, initiated at the set-time, could also be provided. For example, an on-off-on-off sequence could readily be provided by extending the sector gear and extending the cams 50, 62. The switch construction shown in FIG. 3 could also be replaced with a commercially available microswitch. Other modifications and improvements on the invention are also within its scope.

While a preferred embodiment of the invention has been disclosed, this should not be considered a limitation on the invention but only as exemplary thereof; the invention is to be limited only by the following claims.

I claim:

1. An automatic shut-off appliance timer, comprising a clockwork mechanism for actuating an associated appliance at a set-time and deactuating said appliance a predetermined period of time later, said mechanism comprising:

coaxial paired cam and trip wheels, a first one of said cam wheel and said trip wheel being driven by a motor comprised by said clockwork mechanism, and the other of said cam wheel and said trip wheel being rotated with respect to the first thereof in order to establish said set-time, said cam wheel and said trip wheel being spaced from one another by cooperative means prior to said set-time and moving axially with respect to one another when the set-time is reached;

a switch shaft, comprising a first cam means abutting one of said cam wheel and said trip wheel to move said switch shaft axially upon movement of said cam wheel and said trip wheel with respect to one another at the set-time, said switch shaft being fixed to a sector gear which is engaged by means driven by said motor upon said axial movement of said switch shaft at the set-time, so that said switch shaft is rotated by said motor commencing at said set-time, said switch shaft further comprising means for controlling electrical contacts for actuating said associated appliance in response to axial movement of said switch shaft, and said switch shaft comprising a second cam means controlling further axial motion of said switch shaft after a predetermined amount of rotation of said switch shaft, whereby said appliance is deactuated a predetermined time after actuation at said set-time.

2. The timer of claim 1 wherein said cam wheel, trip wheel, and sector gear are confined between a front plate and a back plate, and said first cam means comprises a cam follwer for resting on one of said cam wheel and said trip wheel, whereby said switch shaft is moved axially at said set-time responsive to axial movement of said cam wheel with respect to said trip wheel, and wherein said second cam means formed on said switch shaft comprises a second cam follower riding upon drop-off cam means formed in one of said back plate and front plate, whereby rotation of said switch shaft after said set-time causes said second cam follower to move circumferentially along said drop-off cam means and control the subsequent axial motion of said switch shaft.

3. The timer of claim 1 wherein said switch shaft is moved axially by a user in setting of said timer so that said associated appliance is actuated when said set-time is subsequently reached.

4. The timer of claim 1 wherein said cam wheel is spaced from said trip wheel by a plurality of projections on one of said cam wheel and said trip wheel which interfit with apertures in the other of said cam wheel and said trip wheel when said set-time is reached, when said projections are aligned with said apertures.

5. The timer of claim 2 wherein said switch shaft additionally comprises a retention tab means to engage a stop means formed in said back plate to restrain said switch shaft against rotation prior to said set-time.

6. The timer of claim 1 wherein said sector gear is driven by said hour wheel by way of an intermediary idler gear.

7. The timer of claim 2 further comprising a spring biasing said cam followers axially against said drop-off cams and against one of the pair of said cam wheel and said trip wheel.

8. In an appliance timer providing automatic actuation of an appliance at a set-time, said timer comprising a clockwork mechanism driven by a motor and comprising a cam wheel, a trip wheel, and a switch shaft, said switch shaft controlling said appliance responsive to axial movement of said switch shaft, and wherein said cam wheel is axially spaced from said trip wheel prior to reaching of said set-time and approaches said trip wheel at said set-time, allowing said switch shaft to move axially at the set-time, actuating said appliance, the improvement comprising:

a sector gear formed on said switch shaft for engagement with means driven by said motor to rotate said switch shaft commencing at the set-time, a cam means formed on one of said switch shaft and an associated portion of said timer, and cooperating cam follower means formed on the other of the switch shaft and the associated portion of the timer, for controlling the axial position of said switch shaft responsive to its rotation when rotated by said sector gear, whereby said appliance is deactuated a predetermined time after said set-time.

9. The timer of claim 8, wherein said cam wheel is spaced from said trip wheel by projections formed on one of said cam wheel and said trip wheel, the other of said cam wheel and said trip wheel having actuate slots formed therein, whereby when said projections line up with said slots, said cam wheel is permitted to axially approach said trip wheel, thereby allowing the switch shaft to move axially, whereupon said sector gear is engaged with said motor, rotating said switch shaft and initiating a predetermined period of actuation of the associated appliance.

10. The timer of claim 9 wherein said switch shaft has formed integrally thereon a first cam follower for riding on one of said cam wheel and said trip wheel for controlling axial movement of said switch shaft prior to said set-time, and a second cam follower riding along a cam formed in a front plate comprised by said timer for controlling the axial movement of said switch shaft after occurrence of said set-time.

11. The timer of claim 10 wherein said switch shaft has integrally formed therein a further radially projecting member to interact with a stop in a back plate comprised by said timer to prevent rotation of said switch shaft prior to said set-time.

12. An improved timer for controlling an associated appliance, said timer being set to define a set-time, actuating said appliance upon reaching of said set-time, measuring a predetermined period of time beginning with said set-time, and deactuating said appliance at the end of said predetermined period of time, said timer comprising:

a back plate, carrying a motor and a set of associated electrical contacts for connection to said appliance;

a front plate;

a clockwork mechanism, comprising an hour wheel driven by said motor and a coaxial cam wheel and trip wheel, said cam wheel and said trip wheel moving axially and radially with respect to one another to set said timer, the relative radial positions of said cam wheel and said trip wheel when set defining the set-time, and said cam wheel and said trip wheel moving axially with respect to one another upon reaching of the set-time;

a switch shaft, said switch shaft moving axially in order to control said contacts and hence the actuation and deactuation of said associated appliance, and comprising first cam follower means for riding on stationary cam means formed on one of said front plate and back plate to control the axial position of said switch shaft as a function of its rotation, said switch shaft further comprising a second cam follower riding prior to the set-time on one of said cam wheel and said trip wheel, whereby said switch shaft moves axially when said cam wheel moves with respect to said trip wheel at the occurrence of said set-time; and said switch shaft further comprising a sector gear which is engaged with means driven by said motor upon axial movement of said switch shaft at the set-time, whereby after said set-time, said switch shaft is rotated with respect to said cam means on which said first cam follower means ride.

13. The timer of claim 12, wherein said first cam follower means is formed on said switch shaft and said stationary cam means is formed on one of said front plate and said back plate.

14. The timer of claim 13, further comprising a spring for axially biasing said switch shaft and the associated first and second cam followers against said cam and said one of said cam wheel and trip wheel.

15. The timer of claim 14, wherein said switch shaft additionally comprises an axially extending switch actuation cam portion, said portion comprising a portion of relatively small diameter and plural portions of relatively larger diameter, said switch actuation cam portion extending in juxtaposition to a spring biased arm carrying one of said contacts, whereby as said switch shaft is moved axially said arm and said associated contact are moved correspondingly.

16. The timer of claim 12 wherein one of said cam wheel and said trip wheel comprises a number of projections and the other of said cam wheel and said trip wheel has formed therein a like number of recesses, whereby the projections space the cam wheel from the trip wheel until said projections are axially aligned with said recesses, whereupon said cam wheel is permitted to approach said trip wheel, and said switch shaft moves axially, causing said sector gear to be engaged with means for driving said sector gear driven by said motor.

17. The timer of claim 16 wherein said means for driving said sector gear is a idler gear driven by said motor via an hour wheel.

* * * * *